US005671694A

United States Patent [19]

Schoettle

[11] Patent Number: 5,671,694

[45] Date of Patent: Sep. 30, 1997

[54] EMERGENCY AIR SYSTEM FOR KAYAKERS

[76] Inventor: Fred Schoettle, 1655 Twining Rd., Willow Grove, Pa. 19090

[21] Appl. No.: 630,942

[22] Filed: Apr. 5, 1996

[51] Int. Cl.[6] ..... B63B 35/71

[52] U.S. Cl. ..... 114/347; 441/80

[58] Field of Search ..... 114/347, 360, 114/315, 334, 348, 349; 441/80, 38, 119

[56] References Cited

U.S. PATENT DOCUMENTS

| | | | |
|---|---|---|---|
| 1,766,300 | 6/1930 | Meredith | 441/119 |
| 3,387,580 | 6/1968 | Walker | 114/334 |
| 4,739,720 | 4/1988 | Jarschke | 114/347 |
| 4,838,196 | 6/1989 | Ingram | 114/360 |
| 4,919,631 | 4/1990 | Stafford | 114/315 |
| 5,279,248 | 1/1994 | Blachford | 114/347 |

*Primary Examiner*—Sherman Basinger

[57] ABSTRACT

An emergency air system for enabling kayakers to use air from air bags during emergency situations is disclosed. The air system comprises a kayak having a front end and a rear end with an interior surface and an exterior surface. The kayak also includes an opening for receiving a kayaker, the interior surface having an upper region with a space behind the user. A pair of airbags of a similar configuration are provided, each airbag having an input valve for filling the bags and each airbag having an air outlet orifice for providing air to the kayaker. Next provided is a walled container which has a flap at the front with a fastener for selectively opening and closing the front of the container. The container is adapted to receive and support the airbags and is secured to the kayak. A mouthpiece having an associated valve movable between an open position and a closed position is further provided as well as tubing coupling the air output orifices to each other and to the mouthpiece.

1 Claim, 3 Drawing Sheets

FIG. 3
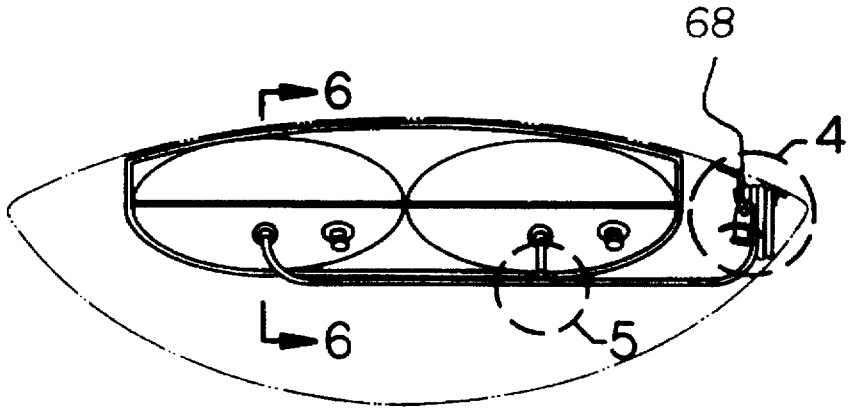
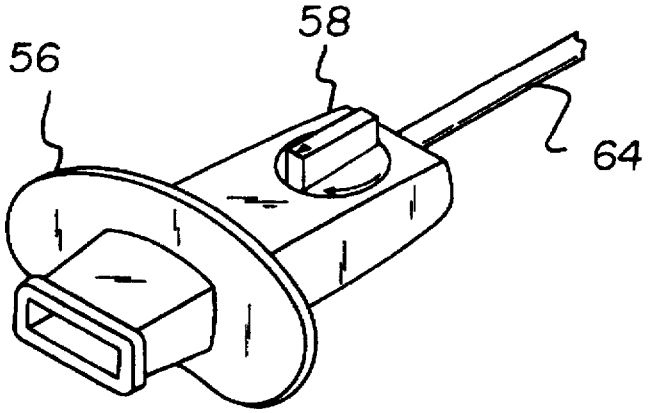
FIG. 4

EMERGENCY AIR SYSTEM FOR KAYAKERS

BACKGROUND OF THE INVENTION

1. Field of the Invention

The present invention relates to a new and improved emergency air system for kayakers and, more particularly, pertains to enabling kayakers to use air from air bags during emergency situations.

2. Description of the Prior Art

The use of kayaks and safety features of various designs and configurations is known in the prior art. More specifically, kayakers and safety features of various designs and configurations heretofore devised and utilized for the purpose of improving the safety of kayakers through various methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,215,031 to Inman et al. dated Jun. 1, 1993 discloses a protection device for a boat having a rigid hull with a waterline, gunwale and a cockpit. The device consists of a first inflatable bumper mounted to the rigid hull about the gunwale and a second inflatable bumper mounted to the rigid hull at the waterline. A mechanism is in the cockpit for selectively inflating the first inflatable bumper and the second inflatable bumper to keep the boat afloat if the hull becomes cracked.

In this respect, the emergency air system for kayakers according to the present invention substantially departs from the conventional concepts and designs of the prior art, and in doing so provides an apparatus primarily developed for the purpose of enabling kayakers to use air from air bags during emergency situations.

Therefore, it can be appreciated that there exists a continuing need for a new and improved emergency air system for kayakers which can be used for enabling kayakers to use air from air bags during emergency situations. In this regard, the present invention substantially fulfills this need.

SUMMARY OF THE INVENTION

In view of the foregoing disadvantages inherent in the known types of kayaks and safety features of various designs and configurations now present in the prior art, the present invention provides a new and improved emergency air system for enabling kayakers to use air from air bags during emergency situations. As such, the general purpose of the present invention, which will be described subsequently in greater detail, is to provide a new and improved emergency air system for enabling kayakers to use air from air bags during emergency situations and methods which have all the advantages of the prior art and none of the disadvantages.

To attain this, the present invention essentially comprises a new and improved emergency air system for enabling kayakers to use air from air bags during emergency situations comprising, in combination, a kayak having a front end and a rear end with an interior surface and an exterior surface and with an opening for receiving a kayaker, the interior surface having an upper region with a space behind the user; a pair of airbags of a similar configuration, each airbag having an input valve for filling the bags with pressurized air and each airbag having an air outlet orifice for providing air to the kayaker during an emergency situation; a container having a top wall with a parallel bottom wall and with parallel side walls therebetween, the container having a closed rear wall coupled to the top, bottom and side walls, the container also having a flap at the front with a pile-type fastener for selectively opening and closing the front of the container, the container adapted to receive and support the airbags, the container being secured to the kayak at the upper region of the space behind the kayaker; a mouthpiece having an associated valve movable between an open position to allow the flow of air therethrough during an emergency situation and a closed position to preclude the flow of air therethrough when not in use; tubing coupling the air output orifices to each other and to the mouthpiece; and a hook secured to the kayak at the upper region of the space behind the kayak to one side of the container for receiving and supporting the tubing when the system is not in use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved emergency air system for enabling kayakers to use air from air bags during emergency situations which has all the advantages of the prior art kayaks and safety features of various designs and configurations and none of the disadvantages.

It is another object of the present invention to provide a new and improved emergency air system for enabling kayakers to use air from air bags during emergency situations which may be easily and efficiently manufactured and marketed.

It is a further object of the present invention to provide a new and improved emergency air system for enabling kayakers to use air from air bags during emergency situations which is of a durable and reliable construction.

An even further object of the present invention is to provide a new and improved emergency air system for enabling kayakers to use air from air bags during emergency situations which is susceptible of a low cost of manufacture with regard to both materials and labor, and which accordingly is then susceptible of low prices of sale to the consuming public, thereby making such an emergency air system for enabling kayakers to use air from air bags during emergency situations economically available to the buying public.

Still yet another object of the present invention is to provide a new and improved emergency air system for enabling kayakers to use air from air bags during emergency situations which provides in the apparatuses and methods of the prior art some of the advantages thereof, while simultaneously overcoming some of the disadvantages normally associated therewith.

Even still another object of the present invention is to enable kayakers to use air from air bags during emergency situations.

Lastly, it is an object of the present invention to provide an emergency air system for enabling kayakers to use air from air bags during emergency situations. The air system comprises a kayak having a front end and a rear end with an interior surface and an exterior surface. The kayak also includes an opening for receiving a kayaker, the interior surface having an upper region with a space behind the user. A pair of airbags of a similar configuration are provided, each airbag having an input valve for filling the bags and each airbag having an air outlet orifice for providing air to the kayaker. Next provided is a walled container which has a flap at the front with a fastener for selectively opening and closing the front of the container. The container is adapted to receive and support the airbags and is secured to the kayak. A mouthpiece having an associated valve movable between an open position and a closed position is further provided as well as tubing coupling the air output orifices to each other and to the mouthpiece.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 front elevational view of the emergency air system shown in FIG. 2.

FIG. 4 is an enlarged perspective view of the mouthpiece taken at circle 4 of FIG. 3.

The same reference numerals refer to the same parts throughout the various Figures.

DESCRIPTION OF THE PREFERRED EMBODIMENT

Figure 1:
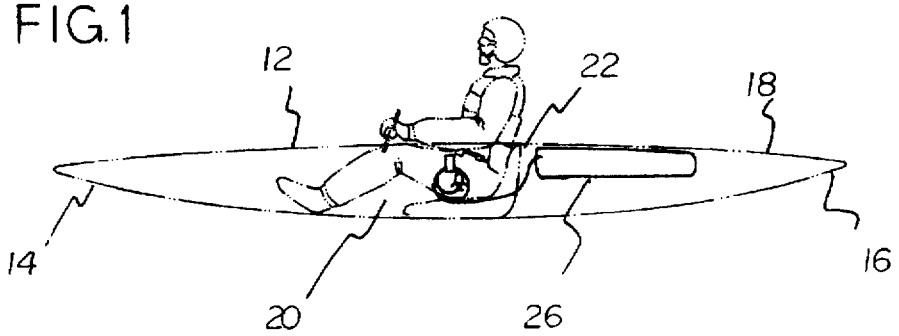
FIG. 1 is a side elevational view of a kayak with an emergency air system constructed in accordance with the principles of the present invention.
Figure 2:
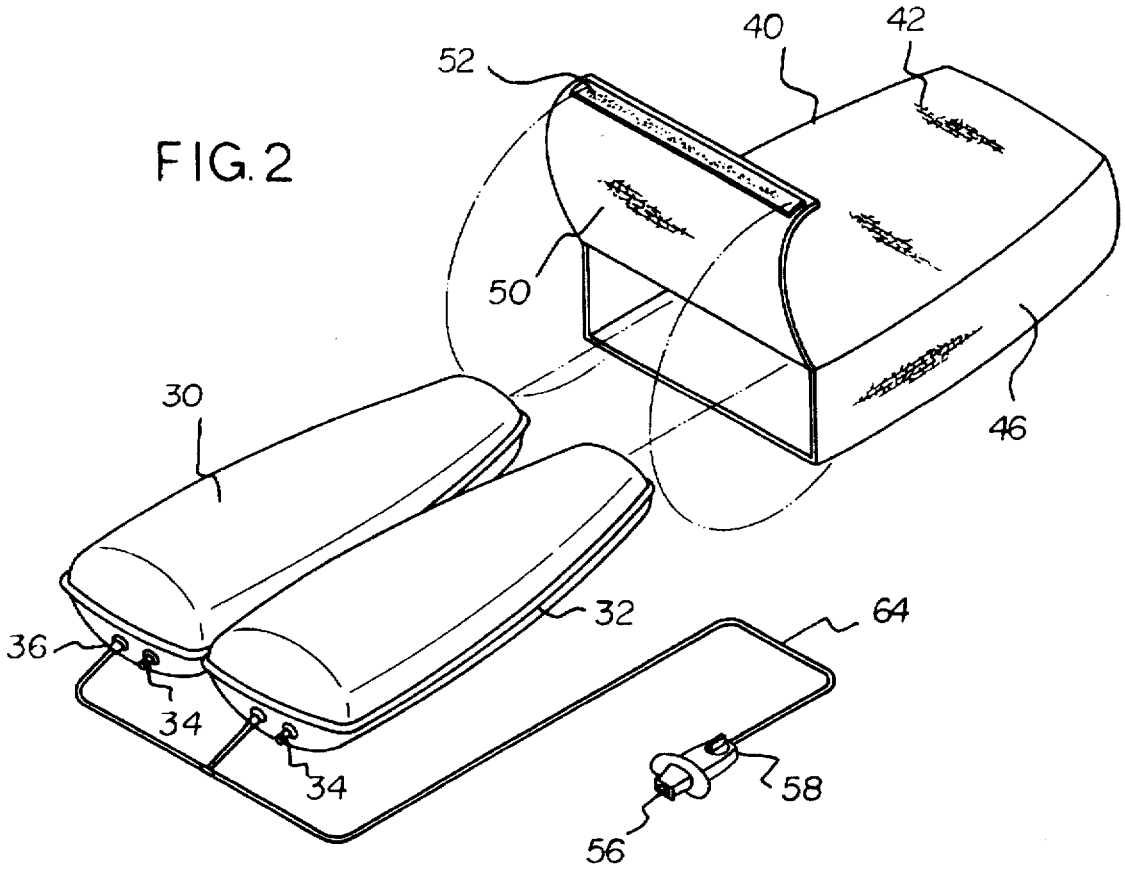
FIG. 2 is an exploded perspective illustration of the emergency air system shown in FIG. 1.
Figure 5:
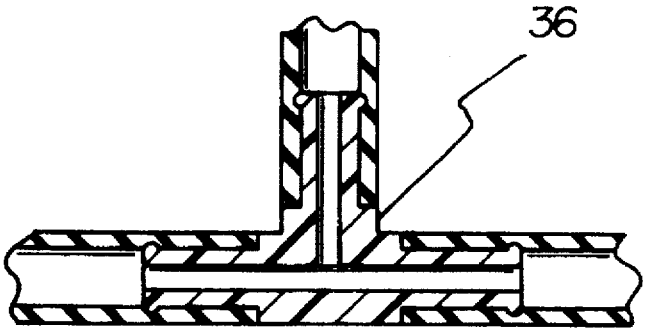
FIG. 5 is a cross-sectional view taken at circle 5 of FIG. 3.
Figure 6:
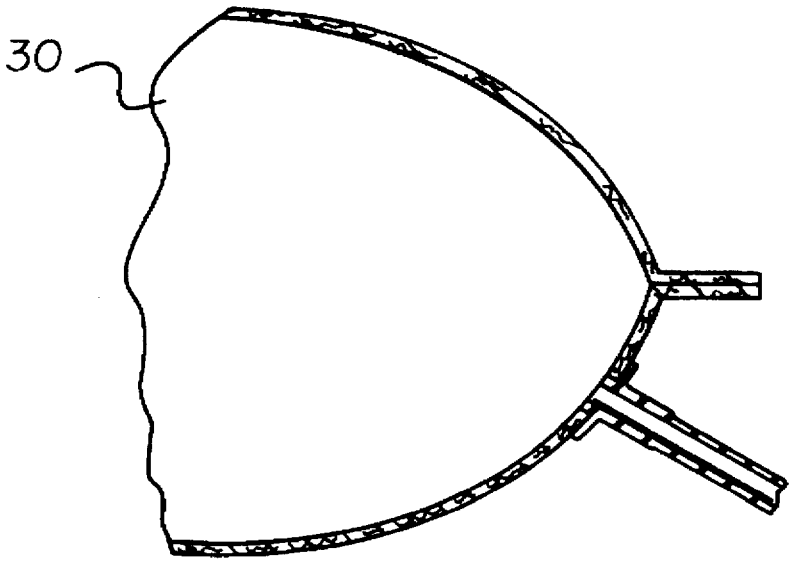
FIG. 6 is a cross-sectional view taken along line 6—6 of FIG. 5.

With reference now to the drawings, and in particular to FIG. 1 thereof, the preferred embodiment of the new and improved emergency air system for enabling kayakers to use air from air bags during emergency situations embodying the principles and concepts of the present invention and generally designated by the reference numeral 10 will be described.

The present invention is an emergency air system 10. It is adapted to be used in association with a kayak 12. The kayak is of the type having a front end 14 and a rear end 16. The kayak also has an exterior surface 18 and an interior surface 20. The kayak also includes an opening for receiving a kayaker 22 during operation and use. The interior surface has an upper region 24 with a space 26 behind the user.

In association with the kayak are a pair of airbags 30. The airbags are of a similar construction with a peripheral hem 32. Each airbag has an air input valve 34. Such valve is for filling the bags with the pressurized air to be used during an emergency situation. Each of the bags also has an air outlet orifice 36 for providing air from the bag to the user of the kayak during an emergency situation.

A container 40 is next provided. The container has a top wall 42 and a parallel bottom wall 44. The container also has generally parallel side walls 46. The side walls are coupled at their upper and lower edges to the edges of the top and bottom walls. In addition, a closed rear wall 48 is coupled to the top, bottom and side walls of the container. Lastly as part of the container is a flap 50. The flap is located at the front of the container. It has along its free edge a pile-type fastener 52. The flap with its fastener is for selectively opening and closing the container. The container is adapted to receive and support the airbags during operation and use. The container is secured at its upper surface to the kayak at the upper region of the space behind the kayaker.

Next provided as part of the system is a mouthpiece 56. The mouthpiece has a valve 58. The valve is movable from an open position. When in the open position the mouthpiece allows the flow of air therethrough. The mouthpiece also has its actuating mechanism 60 movable to a closed position. During the closed position, the valve precludes the flow of air through the mouthpiece.

In association with the mouthpiece and containers is tubing 64. The tubing is configured with appropriate ends to couple the air output orifices to each other. The tubing also allows for coupling of the output orifices to the mouthpiece.

Lastly provided is a hook 68. The hook is secured to the kayak at the upper region of the space behind the kayaker to one side of the container. The hook is for receiving and supporting the tubing when the system is not in use.

The present invention enables a kayaker to breathe in an emergency if the kayak capsizes and the kayaker finds him or herself submerged under water. If this situation occurs, an inexperienced kayaker may panic which increases the potential for drowning. The present invention provides instant air thus buying the submerged kayaker extra time to right him or herself. The mouthpiece of the present invention, once bitten into, breaks a seal which releases air into the lungs of the kayaker.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only if the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved emergency air system for enabling kayakers to use air from air bags during emergency situations comprising, in combination:

a kayak having a front end and a rear end with an interior surface and an exterior surface and with an opening for receiving a kayaker, the interior surface having an upper region with a space behind the user;

a pair of airbags of a similar configuration, each airbag having an input valve for filling the bags with pressurized air and each airbag having an air outlet orifice for providing air to the kayaker during an emergency situation;

a container having a top wall with a parallel bottom wall and with parallel side walls therebetween, the container having a closed rear wall coupled to the top, bottom and side walls, the container also having a flap at the front with a pile-type fastener for selectively opening and closing the front of the container, the container adapted to receive and support the airbags, the container being secured to the kayak at the upper region of the space behind the kayaker;

a mouthpiece having an associated valve movable between an open position to allow the flow of air therethrough during an emergency situation and a closed position to preclude the flow of air therethrough when not in use;

tubing coupling the air output orifices to each other and to the mouthpiece; and a hook secured to the kayak at the upper region of the space behind the kayak to one side of the container for receiving and supporting the tubing when the system is not in use.

* * * * *